US009932185B2

(12) United States Patent
Suzuki

(10) Patent No.: US 9,932,185 B2
(45) Date of Patent: Apr. 3, 2018

(54) SHEET MATERIAL FEEDING APPARATUS

(71) Applicant: Sankyo Seisakusho Co., Tokyo (JP)

(72) Inventor: Kengo Suzuki, Kikugawa (JP)

(73) Assignee: Sankyo Seisakusho Co., Tokyo (JP)

( * ) Notice: Subject to any disclaimer, the term of this patent is extended or adjusted under 35 U.S.C. 154(b) by 0 days.

(21) Appl. No.: 15/207,429

(22) Filed: Jul. 11, 2016

(65) Prior Publication Data

US 2017/0015515 A1 Jan. 19, 2017

(30) Foreign Application Priority Data

Jul. 13, 2015 (JP) ..... 2015-139600

(51) Int. Cl.

| | |
|---|---|
| ***B65H 5/06*** | (2006.01) |
| ***B21D 43/09*** | (2006.01) |
| *B65H 20/02* | (2006.01) |

(52) U.S. Cl.

CPC ..... *B65H 5/062* (2013.01); *B21D 43/09* (2013.01); *B65H 20/02* (2013.01); *B65H 2403/82* (2013.01); *B65H 2404/144* (2013.01); *B65H 2404/147* (2013.01); *B65H 2404/1441* (2013.01); *B65H 2404/152* (2013.01); *B65H 2551/12* (2013.01); *B65H 2701/173* (2013.01)

(58) Field of Classification Search

CPC .... B65H 5/062; B65H 20/02; B65H 2402/32; B65H 2402/34; B65H 2402/341; B65H 2404/142; B65H 2404/144; B65H 2404/1441; B65H 2404/152; B65H 2404/1526; B21D 43/09

See application file for complete search history.

(56) References Cited

U.S. PATENT DOCUMENTS

| | | | | |
|---|---|---|---|---|
| 9,598,254 | B2 * | 3/2017 | Gentile | B21D 43/09 |
| 2009/0108522 | A1 * | 4/2009 | Kato | B21C 47/34 271/273 |
| 2009/0120989 | A1 * | 5/2009 | Kato | B21C 47/34 226/181 |

FOREIGN PATENT DOCUMENTS

| | | | |
|---|---|---|---|
| DE | 202006009639 | U1 | 8/2006 |
| EP | 0364017 | A2 | 4/1990 |
| JP | H06-170637 | A | 6/1994 |
| JP | 2009-106990 | A | 5/2009 |
| JP | 2013-536086 | A | 9/2013 |
| TW | I288672 | B | 10/2007 |

OTHER PUBLICATIONS

Extended European Search Report dated Dec. 19, 2016 in related European Patent Application No. 16178935.9-1702.

* cited by examiner

*Primary Examiner* — Michael C McCullough
(74) *Attorney, Agent, or Firm* — Patterson & Sheridan, LLP

(57) ABSTRACT

A sheet material feeding apparatus includes a first roll 106, and a second roll 108 arranged vertically below first roll 106, to feed a sheet material clamped between the first roll 106 and the second roll 108. The sheet material feeding apparatus further includes a first motor 102 provided with a rotatable first motor shaft 104 coupled to the first roll 106, and a second motor 103 provided with a rotatable second motor shaft 105 coupled to the second roll 108. The first motor shaft 104 and the second motor shaft 105 rotate at substantially the same rotation speed to allow the first roll 106 and the second roll 108 to rotate in synchronization with each other.

13 Claims, 7 Drawing Sheets

SHEET MATERIAL FEEDING APPARATUS

INCORPORATION BY REFERENCE

The present application claims priority from Japanese application JP2015-139600 filed on Jul. 13, 2015, the content of which is hereby incorporated by reference into this application.

BACKGROUND OF THE INVENTION

The present invention relates to a sheet material feeding apparatus that intermittently supplies a predetermined amount of a sheet material to a press apparatus or the like at high speed as well as with high accuracy.

JP-A-2013-536086 (corresponding to U.S. Pub. No. US2015/0298188A1) discloses a roll type material feeding apparatus that includes a frame, a first driven feed roll, a second feed roll, a first drive motor that rotates to drive the first driven feed roll by engaging therewith, a second drive motor that rotates to drive the first driven feed roll by engaging therewith, and a first rotational position sensor that rotates in conjunction with the first drive motor. The roll type material feeding apparatus includes speed change gears to enable the second feed roll to be driven in conjunction with the first driven feed roll. The speed change gears include a first drive gear attached to the first driven feed roll, a first driven gear that is driven with the first drive gear by engaging therewith, and an intermediate coupling member for coupling the first driven gear to the second feed roll. The second feed roll is rotatably supported in a movable roll support, and a force generating actuator provided between a frame and the movable roll support is configured to generate holding force between the second feed roll and the first driven feed roll in conjunction with the movable roll support to hold a workpiece between the second feed roll and the first driven feed roll.

JP-A-2009-106990 (corresponding to U.S. Pub. No. US2009/0108522A1) discloses a sheet material feeding apparatus that intermittently supplies a sheet material to a press apparatus, and that includes a main roll and a sub roll to clamp the sheet material and vertically displaces the main roll to adjust a gap between the main roll and the sub roll in accordance with the thickness of the sheet material. The sheet material feeding apparatus is provided with a release device that includes a sub roll guide that is vertically movable integrally with the sub roll, a translating cam, and a cam follower that engages with a cam surface of the translating cam. The release device adjusts a solenoid valve in response to operation of the press apparatus to supply air to a cylinder. The air then moves the translating cam in an axial direction of the sub roll to vertically move the sub roll through the cam follower and the sub roll guide, thereby releasing and clamping the sheet material provided between both the rolls.

SUMMARY OF THE INVENTION

The roll type material feeding apparatus in accordance with JP-A-2013-536086 transmits rotation of the first drive motor that drives the first driven feed roll by engaging therewith to the second feed roll through the speed change gears to enable the second feed roll to be driven in conjunction with the first driven feed roll. In this way, the gears transmit driving force to the second feed roll from the first drive motor, and thus there is a problem in which the gears with backlash deteriorate stopping accuracy of the second feed roll to cause deterioration of accuracy of feed length of the sheet material to be fed. There is also a problem in which using the gears allows teeth of a drive gear and teeth of a driven gear to be brought into contact with each other to wear the teeth, thereby causing backlash to increase over time due to the wear. Although it is possible to lubricate the gears to reduce wear of the gears as much as possible, there is a problem of large maintenance costs.

The roll type material feeding apparatus in accordance with JP-A-2013-536086 also allows the force generating actuator to lift the movable roll support that supports the second feed roll to release a workpiece held between the second feed roll and the first driven feed roll, however, there is a problem in which lifting the movable roll support requires a motor with large capacity or the like to be used as the force generating actuator.

The release device of the sheet material feeding apparatus in accordance with JP-A-2009-106990 adjusts the solenoid valve to supply air to the cylinder, thereby moving the translating cam in the axial direction of the sub roll to release and clamp the sheet material, however, there is a problem in which a system for supplying air to the cylinder is required, and a speed of movement of the translating cam by the air is low.

Thus, it is an object of the present invention to provide a sheet material feeding apparatus to solve the problems above, the sheet material feeding apparatus being capable of intermittently supplying a predetermined amount of a sheet material at high speed as well as with high accuracy to achieve reduction in cost as well as being suitable for long-life use.

According to the present invention, the object above is achieved by a sheet material feeding apparatus that includes a housing, a first roll accommodated in the housing, and a second roll accommodated in the housing and arranged vertically below the first roll. The sheet material feeding apparatus feeds a sheet material clamped between the first roll and the second roll, and further includes a first motor provided with a rotatable first motor shaft coupled to the first roll, and a second motor provided with a rotatable second motor shaft coupled to the second roll. The first motor shaft and the second motor shaft rotate at substantially the same rotation speed to allow the first roll and the second roll to rotate in synchronization with each other.

Another object of the present invention is achieved by the sheet material feeding apparatus in which a difference between a moment of inertia of the first roll and that of the second roll is 0.01% or less.

Yet another object of the present invention is achieved by the sheet material feeding apparatus including a control device that transmits a control signal to at least one of the first motor and the second motor to rotate the first roll and the second roll in synchronization with each other.

Yet another object of the present invention is achieved by the sheet material feeding apparatus in which the control device receives a signal of rotation speed of at least one of the first roll and the second roll to process the received signal of rotation speed.

Yet another object of the present invention is achieved by the sheet material feeding apparatus in which the first motor shaft and the second motor shaft rotate in response to a signal received from outside the sheet material feeding apparatus.

Yet another object of the present invention is achieved by the sheet material feeding apparatus in which the second roll and the second motor shaft are coupled to each other through a joining device that allows the second roll to be movable vertically with respect to the second motor shaft.

Yet another object of the present invention is achieved by the sheet material feeding apparatus including a roll support member that supports the second roll as well as having a lower end provided with a cam bearing, and a cam piston that engages with the cam bearing as well as being horizontally movable. In the sheet material feeding apparatus, the cam bearing with which the cam piston is engaged moves vertically in response to movement of the cam piston to allow the second roll supported by the roll support member to be moved vertically in response to the vertical movement of the cam bearing to clamp or release the sheet material.

Yet another object of the present invention is achieved by the sheet material feeding apparatus including an eccentric cam that is rotatably coupled to the cam piston, and an eccentric cam bearing that supports the eccentric cam, the cam piston moving horizontally in response to rotation of the eccentric cam.

Yet another object of the present invention is achieved by the sheet material feeding apparatus in which the second roll is movable vertically with respect to the second motor shaft in response to the signal received from outside the sheet material feeding apparatus.

Yet another object of the present invention is achieved by the sheet material feeding apparatus including a first elastic member that has an end fixed to the housing as well as a central portion fixed to the roll support member.

Yet another object of the present invention is achieved by the sheet material feeding apparatus including a second elastic member that has an end fixed to the housing as well as a central portion fixed to the roll support member, the second elastic member being arranged vertically below the first elastic member.

Yet another object of the present invention is achieved by a method of feeding the sheet material by using the sheet material feeding apparatus above.

Yet another object of the present invention is achieved by a method of manufacturing a structure by working the sheet material fed by the method above.

In the present invention, the motor shaft provided in each of the motors is coupled to the corresponding roll to rotate the roll, and thus a heavy object can be fed to enable feeding capacity to be increased. In addition, gears such as used in JP-A-2013-536086 are not used, thereby achieving the following effects: no backlash can improve accuracy of feed length of the sheet material to be fed; eliminating wear of teeth caused by engagement of the teeth can improve accuracy of feed length of the sheet material over time, and thus maintenance costs can be reduced; and reducing a difference between moments of inertia of the respective rolls to 0.01% or less enables the respective rolls to be rotated in synchronization with each other. Further, the following effects are also achieved: controlling a rotation speed of each of the motor shafts by a control signal transmitted from the control device enables the respective rolls to be rotated in synchronization with each other; allowing the control device to process a control signal of detected rotation speed of each of the rolls, as well as controlling a rotation speed of each of the motor shafts by using the processed control signal, enables the respective rolls to be rotated further in synchronization with each other; and rotating each of the motor shafts in response to an externally transmitted signal from a device working the sheet material fed from the sheet material feeding apparatus, or the like, enables the sheet material to be fed from the sheet material feeding apparatus in synchronization with a working process of the sheet material.

Furthermore, the following effects are also achieved: coupling the second roll and the second motor shaft through the joining device movable vertically enables the sheet material to be clamped and released by moving the second roll vertically without changing a vertical position of the second motor; using the cam piston movable horizontally, engaging with the cam bearing, enables the sheet material to be clamped and released by a motor with small capacity at low cost without using a motor with large capacity, such as used in JP-A-2013-536086; moving the cam piston horizontally in response to rotation of the eccentric cam coupled to the cam piston enables the sheet material to be clamped and released at high speed as well as at low cost; and moving the second roll vertically in response to the externally transmitted signal from the device working the sheet material fed from the sheet material feeding apparatus, or the like, enables the sheet material to be clamped or released in synchronization with the working process of the sheet material.

The elastic member is also provided to operate only on vertical movement of the second roll, as well as to achieve an effect of enabling reduction in horizontal runout of the second roll caused by inertial force generated when the second roll is rotated and horizontal inertial force generated when the sheet material is fed. Providing a plurality of elastic members can further increase the effect.

Using the sheet material feeding apparatus of the present invention achieves an effect of enabling the sheet material to be fed at high speed as well as with high accuracy, and an effect of enabling a structure to be manufactured from the sheet material fed by that way at high speed as well as with high accuracy.

Other objects, features, and advantages of the invention will become apparent from the following description of the embodiments of the invention taken in conjunction with the accompanying drawings.

DETAILED DESCRIPTION OF THE EMBODIMENT

Although an embodiment of the present invention will be described below with reference to drawings, the present invention is not limited to the embodiment.

Figure 1:
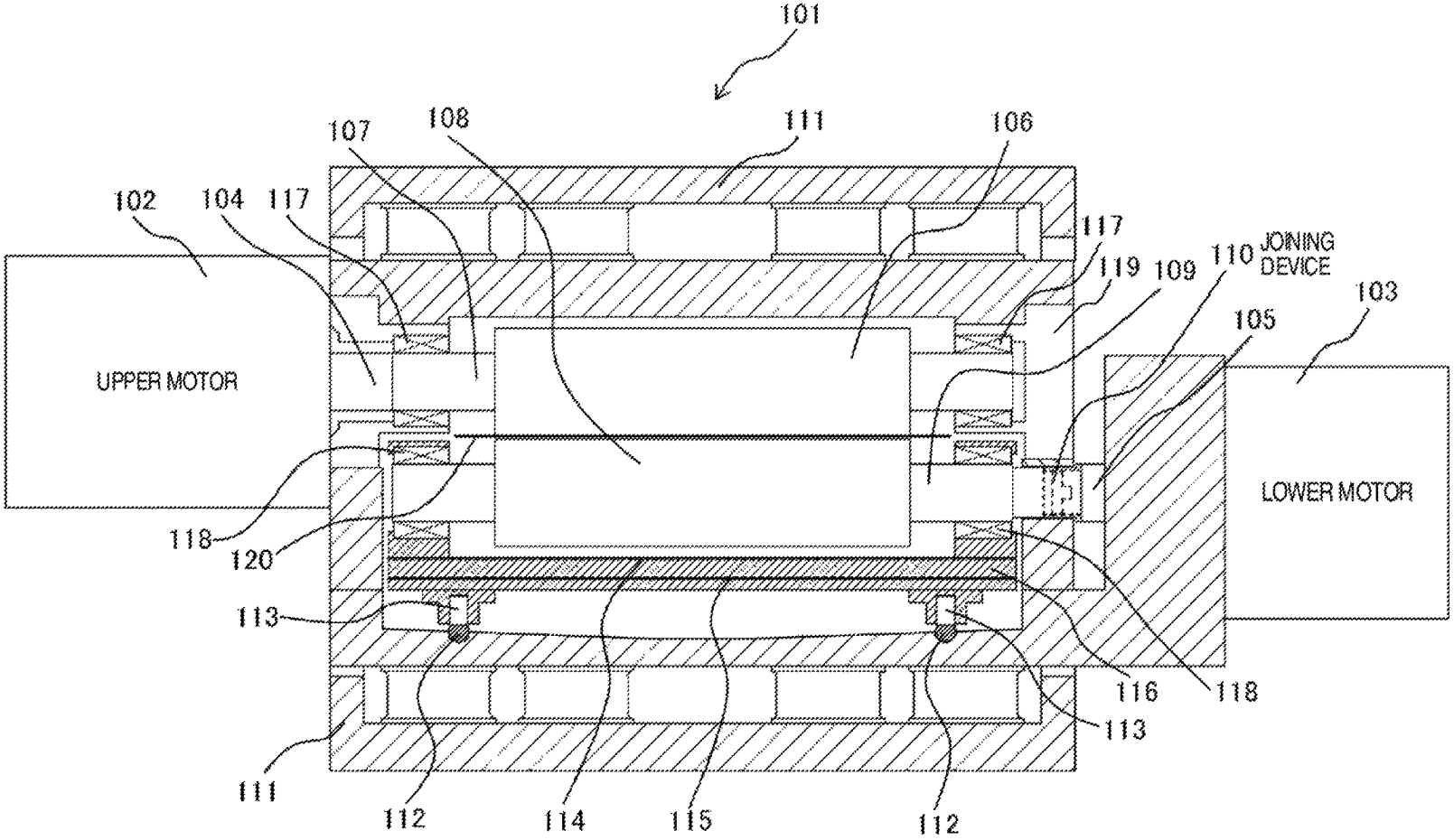
FIG. 1 is a sectional schematic view of a sheet material feeding apparatus of the present invention as viewed from front.

The embodiment of the sheet material feeding apparatus of the present invention will be described with reference to FIGS. 1 to 7. A schematic view of a sheet material feeding apparatus 101 is shown in FIG. 1. The sheet material feeding apparatus 101 includes a housing 111, a first roll (upper roll 106) accommodated in the housing 111, and a second roll (lower roll 108) that is accommodated in the housing 111 and is arranged vertically below the upper roll 106. The upper roll 106 and the lower roll 108 are brought into contact with a sheet material 120 to clamp it, and then the upper roll 106 and the lower roll 108 rotate to feed the clamped sheet material 120. The sheet material feeding apparatus 101 includes a first motor (upper motor 102) provided with a rotatable first motor shaft (upper motor shaft 104), and a second motor (lower motor 103) provided with a rotatable second motor shaft (lower motor shaft 105). The upper motor shaft 104 is coupled to the upper roll 106 through an upper roll shaft 107, and the lower motor shaft 105 is coupled to the lower roll 108 through a lower roll shaft 109. Coupling by that way allows the upper roll 106 supported by upper roll bearings 117 to be rotated with respect to the housing 111 by the upper motor shaft 104, and the lower roll 108 supported by lower roll bearings 118 to be rotated with respect to the housing 111 by the lower motor shaft 105, and thus the rolls 106 and 108 are rotated by the motor shafts 104 and 105, respectively. As a result, the sheet material with large weight also can be fed, and thus the sheet material feeding apparatus 101 with high feeding capacity can be provided.

An eccentric flange 119 is attached to the housing 111 of the sheet material feeding apparatus 101, and the eccentric flange 119 includes a substantially cylindrical outer peripheral surface formed by centering an eccentric axis displaced from an axis of the upper roll 106, and a substantially cylindrical inner peripheral surface that is concentric with the axis of the upper roll 106. The upper roll shaft 107 supported by upper roll bearings 117 and provided at axially opposite ends of the upper roll 106 is rotatably attached to the housing 111 through the eccentric flange 119, and then the eccentric flange 119 is rotated around the eccentric axis with respect to the housing 111 to allow the upper roll 106 to be vertically displaced.

A difference between a moment of inertia of the upper roll 106 and a moment of inertia of the lower roll 108 is 0.01% or less, is preferably 0.005% or less, and is more preferably 0.001% or less. Equalizing the moment of inertia of the upper roll 106 and the moment of inertia of the lower roll 108 to each other equalizes a load of each of the motor shafts 104 and 105 with respect to one of the corresponding rolls 106 and 108, and thus rotating the upper motor shaft 104 and lower motor shaft 105 at substantially the same rotation speed facilitates rotating the upper roll 106 and lower roll 108 in synchronization with each other.

Figure 2:
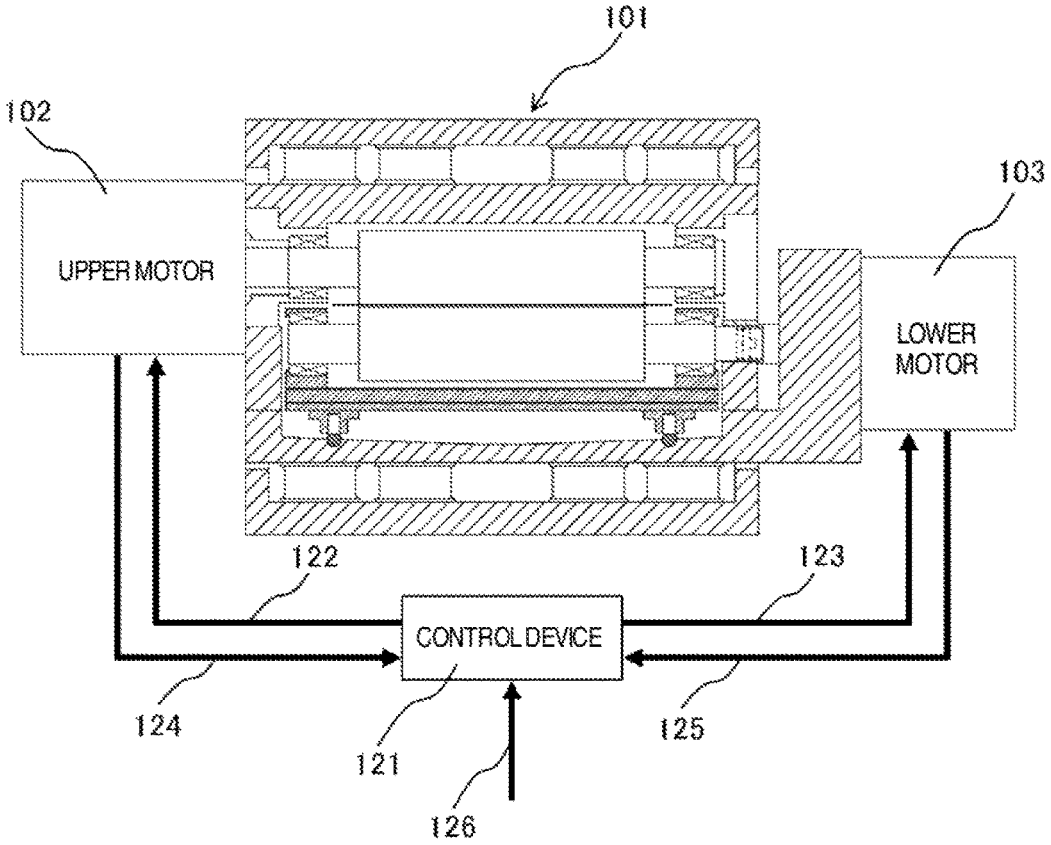
FIG. 2 is a schematic view showing a method of controlling motors of the sheet material feeding apparatus of the present invention.

As shown in FIG. 2, the upper motor 102 and the lower motor 103 may be connected to a control device 121. The control device 121 may be arranged inside the sheet material feeding apparatus 101, or outside the sheet material feeding apparatus 101. The control device 121 is composed of a programmable logic controller (PLC), and the like. The control device 121 is programmed to enable control signals 122 and 123 to be outputted to the upper motor 102 and the lower motor 103, respectively. For example, if the upper motor shaft 104 and the lower motor shaft 105 are set to be rotated in synchronization with each other at a predetermined rotation speed, the control device 121 outputs the control signals 122 and 123 to the upper motor 102 and the lower motor 103, respectively, and then servo amplifiers provided in the upper motor 102 and the lower motor 103 process the control signals 122 and 123, respectively, thereby rotating the upper motor shaft 104 and the lower motor shaft 105 at the predetermined rotation speed.

The sheet material feeding apparatus 101 also includes a rotation angle sensor that measures rotation angles of the upper roll 106 and the lower roll 108 to detect rotation speeds thereof. The rotation angle sensor includes, for example, a magnetic resolver, and an optical encoder. The control device 121 receives signals 124 and 125 of the rotation speeds detected by the rotation angle sensor to determine whether the detected rotation speeds correspond to the predetermined rotation speed, and then outputs the control signals 122 and 123 to the upper motor 102 and the lower motor 103, respectively, so that the upper roll 106 and the lower roll 108 can be rotated at the predetermined rotation speed in synchronization with each other. In this way, controlling rotation speeds of the respective motor shafts 104 and 105 by using the control signals 122 and 123 based on determination of the rotation speeds 124 and 125 of the rolls 106 and 108, respectively, enables the respective rolls 106 and 108 to be rotated in synchronization with each other.

The sheet material feeding apparatus 101 may receive an external signal 126 so that the upper motor shaft 104 and the lower motor shaft 105 can be rotated in response to the external signal 126. For example, the sheet material feeding apparatus 101 may receive the signal 126 from a press apparatus that presses the sheet material 120 fed from the sheet material feeding apparatus 101. The control device 121 receives the external signal 126, and then can control the sheet material 120 to be fed from the sheet material feeding apparatus 101 so as to synchronize with a working process of an apparatus that works the fed sheet material 120, such as a press apparatus, by allowing the rolls 106 and 108 to be rotated through the control signals 122 and 123, respectively.

Figure 7:
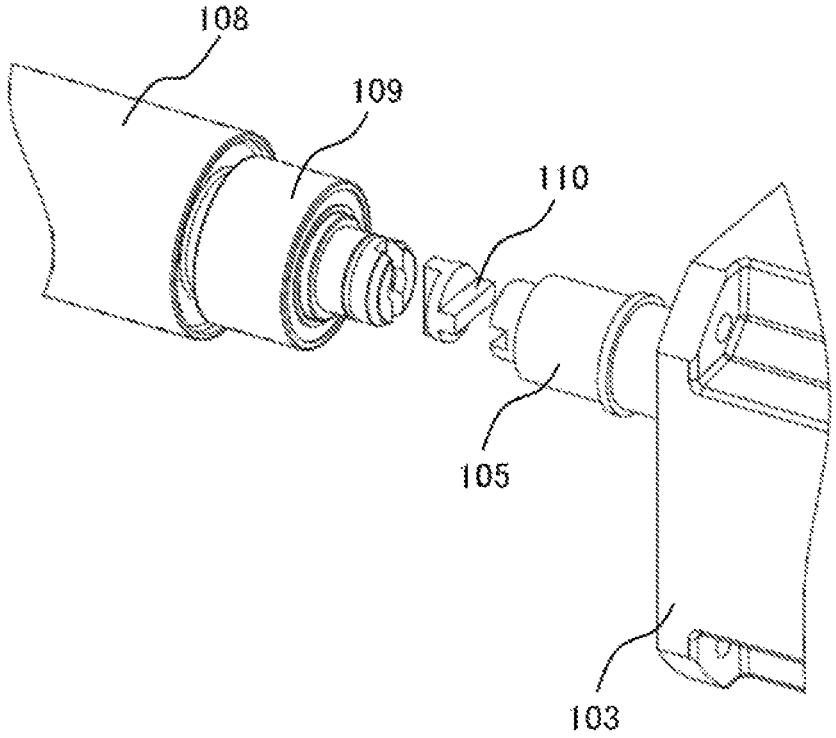
FIG. 7 is a perspective view showing a relationship among a roll shaft, a joining device, and a motor shaft of the sheet material feeding apparatus of the present invention.

In FIG. 7, a perspective view illustrating a relationship among the lower roll shaft 109 of the lower roll 108, a joining device 110, and the lower motor shaft 105 of the lower motor 103, is shown. In the sheet material feeding apparatus 101, the lower roll shaft 109 and the lower motor shaft 105 are coupled to each other through the joining device 110. As the joining device 110, there is an available device that allows the lower roll 108 to be movable vertically upward through the lower roll shaft 109 when the sheet material 120 needs to be clamped, and that allows the lower roll 108 to be movable vertically downward through the lower roll shaft 109 when the sheet material 120 needs to be released. This kind of joining device includes an Oldham's coupling, for example. The joining device 110 can allow the lower roll 108 to be moved vertically without changing a position of the lower motor 103 to clamp or release the sheet material 120.

As shown in FIGS. 1 to 4, the sheet material feeding apparatus 101 includes a roll support member 116 in the housing 111, and the roll support member 116 rotatably supports opposite ends of the lower roll 108 through the lower roll bearings 118. The roll support member 116 is movable vertically together with the lower roll 108, or can be displaced vertically, and is vertically urged by elastic members 114 and 115. That is, the roll support member 116 is moved vertically to enable the sheet material 120 to be clamped or released without changing a position of the lower motor 103 by using the joining device 110. The roll support member 116 is provided at its lower end with cam bearings 113 that can roll. The cam bearing 113 includes a cam follower, and a roller follower, for example.

As shown in FIGS. 1 to 4, the sheet material feeding apparatus 101 includes a cam piston 112 that is movable horizontally and vertically to an axis of the lower roll 108. The cam piston 112 may be movable horizontally in a direction parallel to the axis of the lower roll 108. The cam piston 112 includes cam surfaces 112*a*, and engages with the cam bearings 113 through the respective cam surfaces 112*a*. Although FIGS. 3 and 4 each show the cam piston 112 including the two cam surfaces 112*a* that are spaced at a predetermined interval in the longitudinal direction, and that engage with the respective cam bearings 113, the numbers of the cam bearings and the cam surfaces are not limited to the numbers described above. The cam surface 112*a* of the cam piston 112 includes a first recessed portion 112*b* and a second recessed portion 112*c* recessed more than the first recessed portion 112*b* so as to allow the lower roll 108 to be movable vertically through the roll support member 116.

Figure 3:
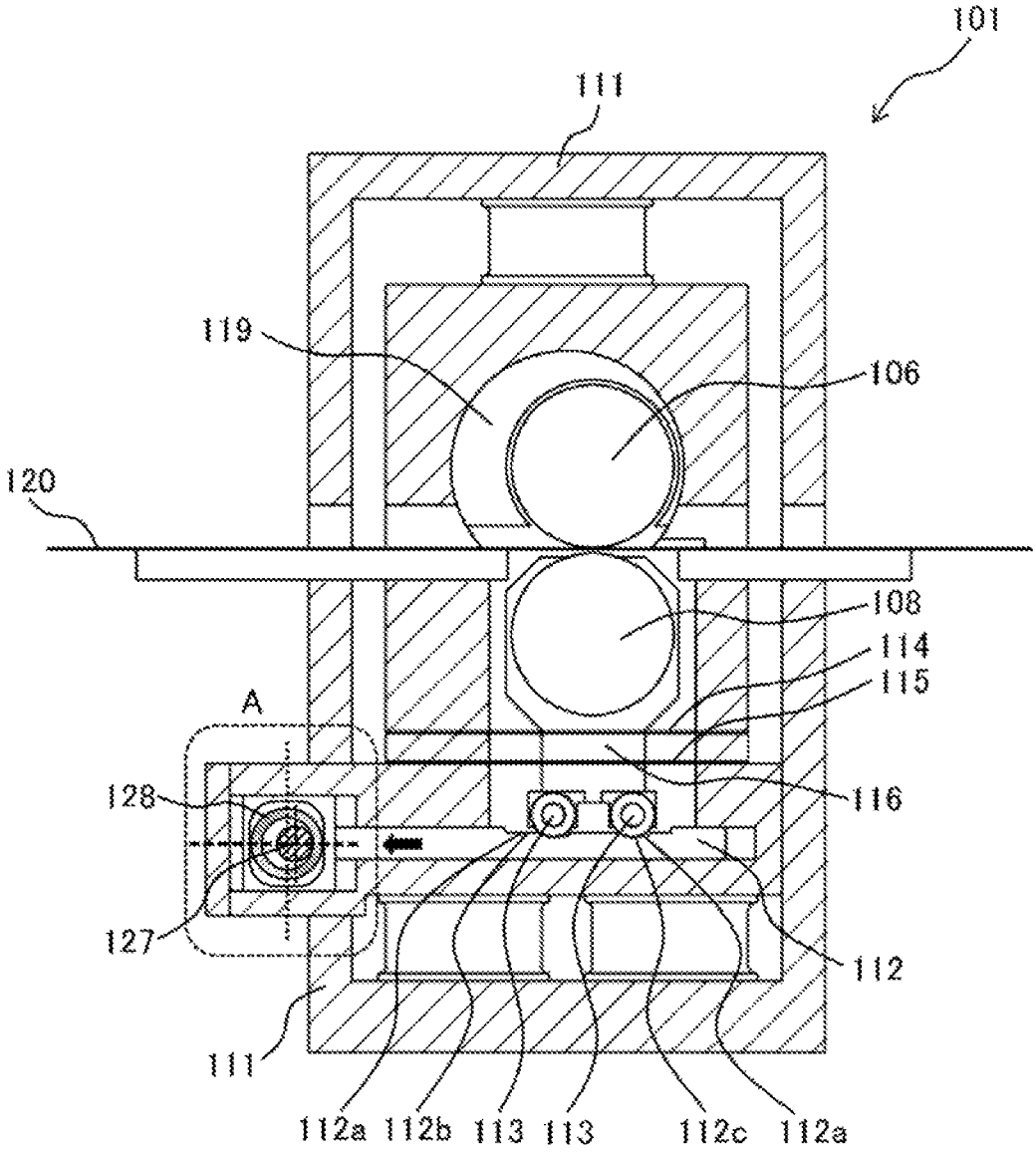
FIG. 3 is a sectional schematic view of the sheet material feeding apparatus of the present invention when a sheet material is released, as viewed from side.
Figure 4:
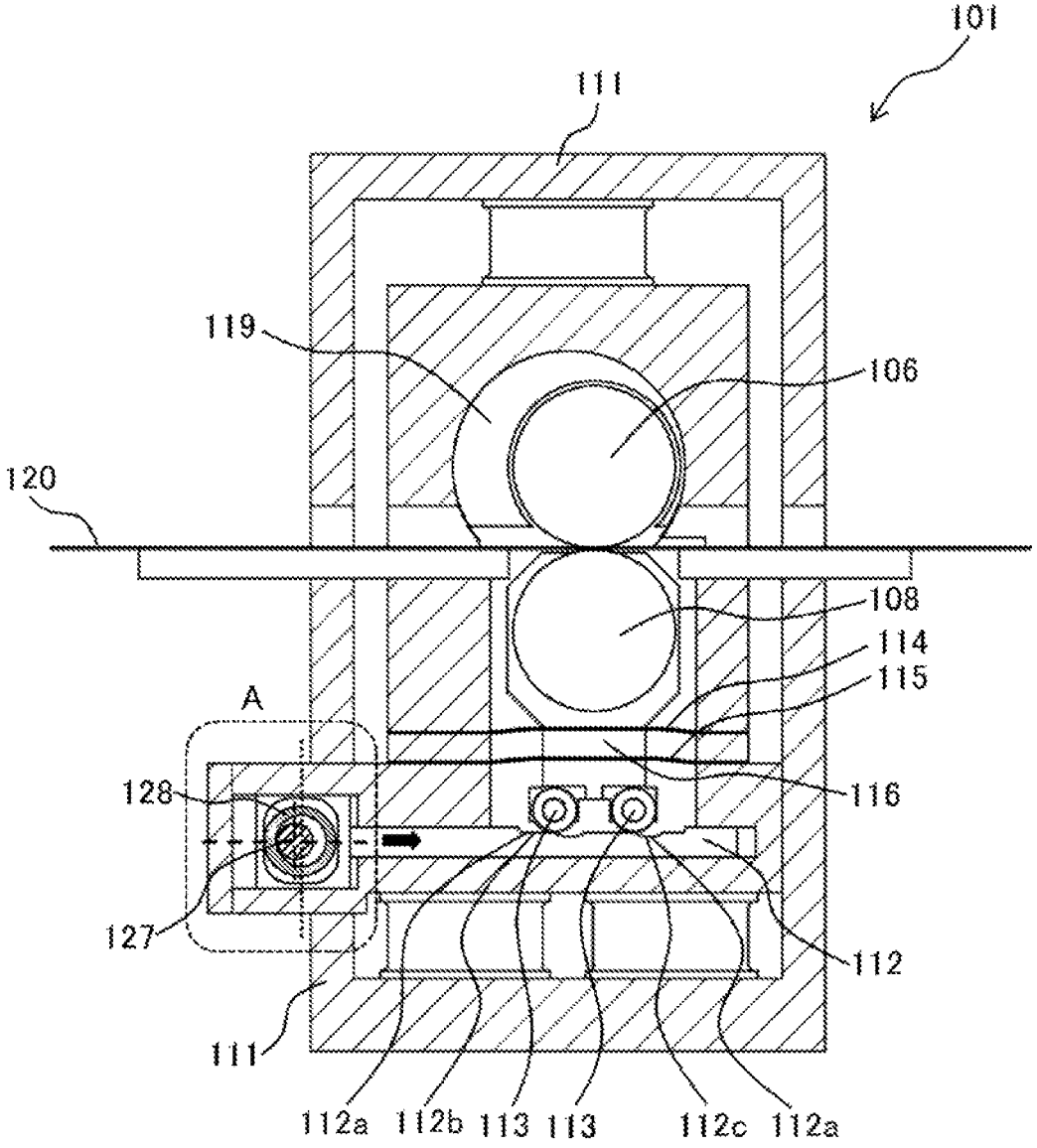
FIG. 4 is a sectional schematic view of the sheet material feeding apparatus of the present invention when the sheet material is clamped, as viewed from side.

The cam piston 112, as shown in FIGS. 3 and 4, can be moved horizontally and vertically to the axis of the lower roll 108. In FIG. 3, when the cam piston 112 is moved in the arrow direction, each of the cam bearings 113 rolls along the cam surface 112*a* of cam piston 112, and then engages with the second recessed portion 112*c* of the cam surface 112*a*. Engagement of the cam bearing 113 and the second recessed portion 112*c* allows the roll support member 116 including the cam bearings 113 to be moved vertically downward while pressed downward by the elastic members 114 and 115 by a depth of the second recessed portion 112*c* from the first recessed portion 112*b*. As a result, the lower roll 108 is moved vertically downward to enable the sheet material 120 to be released. In FIG. 4, when the cam piston 112 is moved in the arrow direction, each of the cam bearings 113 rolls along the cam surface 112*a* of cam piston 112, and then engages with the first recessed portion 112*b* of the cam surface 112*a*. Engagement of the cam bearing 113 and the first recessed portion 112*b* allows the roll support member 116 including the cam bearings 113 to be moved vertically upward against elastic force of the elastic members 114 and 115 by a height of the first recessed portion 112*b* from the second recessed portion 112*c*. As a result, the lower roll 108 supported by the roll support member 116 is moved vertically upward to enable the sheet material 120 to be clamped. In FIGS. 1 to 4, although the two elastic members are arranged, one elastic member as well as three or more elastic members, are available. The elastic member may be a diaphragm.

Figure 5:
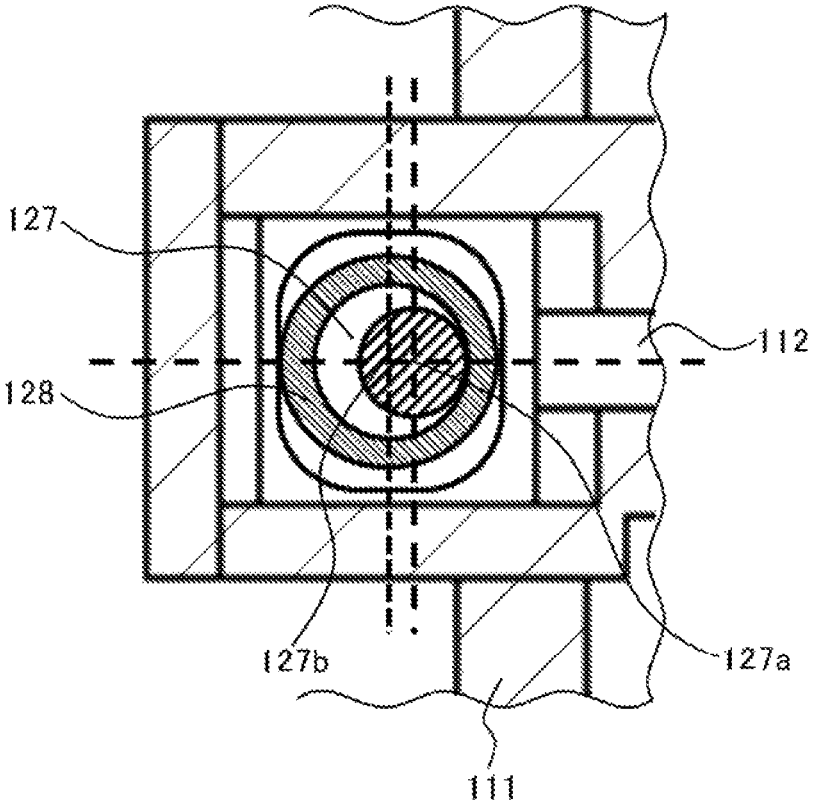
FIG. 5 is an enlarged sectional schematic view of a portion A of FIG. 3.
Figure 6:
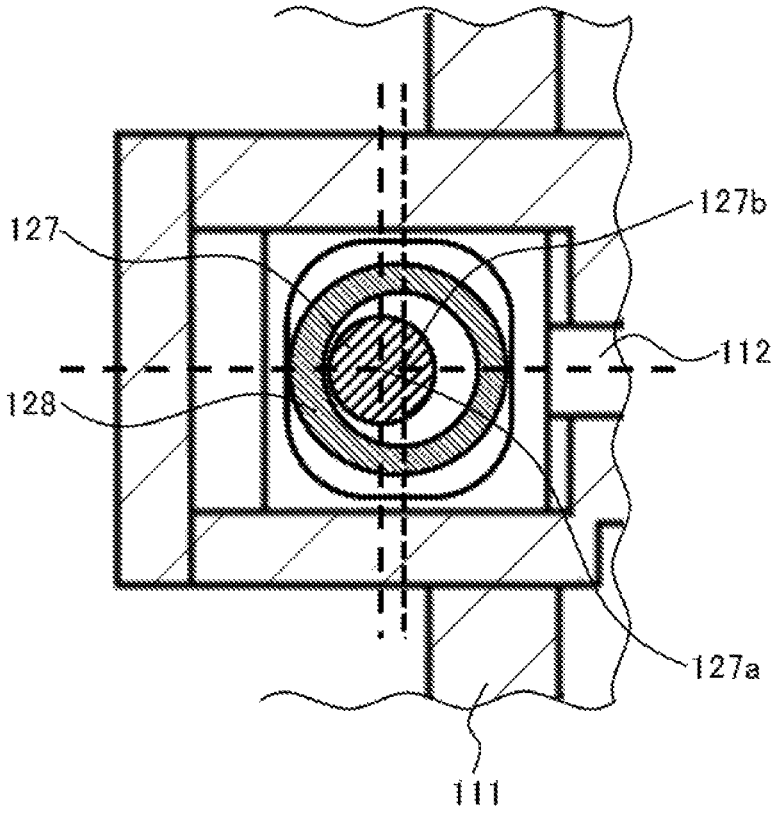
FIG. 6 is an enlarged sectional schematic view of a portion A of FIG. 4.

As shown in FIGS. 1 to 4, the sheet material feeding apparatus 101 includes a rotatable eccentric cam 127 coupled to the cam piston 112, and an eccentric cam bearing 128 that supports the eccentric cam 127. Enlarged views of portions A in FIGS. 3 and 4 are shown in FIGS. 5 and 6, respectively. The eccentric cam 127 has a substantially columnar shape, and is supported by the eccentric cam bearing 128 so that an axis 127*b* of the substantially columnar shape is to be displaced from an axis of rotation 127*a*. When the eccentric cam 127 is rotated around the axis of rotation 127*a* of the eccentric cam 127 by a motor or the like, the axis 127*b* is positioned on a side opposite to the cam piston 112 with respect to the axis of rotation 127*a* in FIG. 5, and thus the cam piston 112 is moved in the arrow direction in FIG. 3 to allow each of the cam bearings 113 to roll into the second recessed portion 112*c* of the cam surface 112*a*. In FIG. 6, the axis 127*b* is positioned on the same side as the cam piston 112 with respect to the axis of rotation 127*a*, and thus the cam piston 112 is moved in the arrow direction in FIG. 4 to allow each of the cam bearings 113 to roll into the first recessed portion 112*b* of the cam surface 112*a*. In this way, the cam piston 112 is moved horizontally in response to the eccentric cam 127 rotating around the axis of rotation 127*a* to enable the sheet material 120 to be clamped or released at high speed. Using the eccentric cam in this way enables response from rotation of the eccentric cam to clamping and releasing of the sheet material to be performed at high speed, as well as enabling adjustment of the eccentric cam to be performed to stop rotation thereof halfway, for example.

The sheet material feeding apparatus 101 receives the external signal 126, and the eccentric cam 127 may be rotated in response to the external signal 126. For example, the sheet material feeding apparatus 101 may receive the signal 126 from a press apparatus that presses the sheet material 120 fed from the sheet material feeding apparatus 101. The control device 121 receives the external signal 126 to enable the sheet material feeding apparatus 101 to clamp or release the sheet material 120 to feed it to a processing apparatus so as to synchronize with a working process of the processing apparatus that works the sheet material 120 by rotating the eccentric cam 127 using a motor or the like to move the cam piston 112 horizontally to move the lower roll 108 supported by the roll support member 116 vertically.

Respective ends of the elastic members 114 and 115 are fixed to the housing 111, and respective central portions thereof are fixed to the roll support member. The elastic member 115 is arranged vertically below the elastic member 114. In this way, the sheet material feeding apparatus 101 includes the elastic members 114 and 115 to allow the elastic members 114 and 115 to urge the lower roll 108 for its vertical movement, but not to urge the lower roll 108 for its horizontal movement. As a result, it is possible to reduce horizontal runout of the lower roll 108 caused by inertial force generated when the lower roll 108 is rotated and horizontal inertial force generated when the sheet material 120 is fed.

In FIGS. 1 to 4, although the two elastic members 114 and 115 are arranged, only one of the elastic members 114 and 115 may be arranged, and an elastic member may be additionally arranged. Arranging the additional elastic member can further reduce the horizontal runout of the lower roll 108.

Using the sheet material feeding apparatus 101 of the present invention such as described above can feed the sheet material 120 at high speed as well as with high accuracy, and also can intermittently feed a predetermined amount of the sheet material 120. Subsequently, a processing apparatus, such as a press apparatus, applies a working process, such as press work, to the sheet material 120 fed from the sheet material feeding apparatus 101 at high speed as well as with high accuracy. As a result, it is possible to manufacture a small-sized component to be used in an information-related apparatus, such as a cellular phone and a personal computer, and a structure, such as a motor to be used in an automobile.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A sheet material feeding apparatus, comprising:

a housing;

a first roll accommodated in the housing;

a second roll accommodated in the housing and arranged vertically below the first roll;

a first motor provided with a rotatable first motor shaft coupled to the first roll;

a second motor provided with a rotatable second motor shaft;

a joining device that couples the second roll and the second motor shaft to allow the second roll to be movable vertically with respect to the second motor shaft;

a roll support member that is vertically movable and supports the second roll, the roll support member including a cam bearing at a lower end thereof;

a cam piston that is movable in a direction which is horizontal and orthogonal to a rotational axis of the second roll, and engages with the cam bearing to move the roll support member vertically as the cam piston moves horizontally; and an eccentric cam configured to move the cam piston horizontally as the eccentric cam rotates, wherein a sheet material is fed while clamped between the first roll and the second roll and, while the sheet material is clamped, the eccentric cam is rotated to move the cam piston horizontally and the roll support member vertically to release the sheet material, and the first motor shaft and the second motor shaft rotate at substantially the same rotation speed to allow the first roll and the second roll to rotate in synchronization with each other.

2. The sheet material feeding apparatus according to claim 1, wherein a difference between a moment of inertia of the first roll and that of the second roll is 0.01% or less.

3. The sheet material feeding apparatus according to claim 1, further comprising:

a control device that transmits a control signal to at least one of the first motor and the second motor to rotate the first roll and the second roll in synchronization with each other.

4. The sheet material feeding apparatus according to claim 3, wherein the control device receives a signal of rotation speed of at least one of the first roll and the second roll to process the received signal of rotation speed.

5. The sheet material feeding apparatus according to claim 1, wherein the first motor shaft and the second motor shaft rotate in response to a signal, from a press apparatus that presses the sheet material fed from the sheet material feeding apparatus, received by a control device.

6. The sheet material feeding apparatus according to claim 1, further comprising a third motor configured to receive a signal and rotate the eccentric cam based on the received signal, wherein the second roll is movable vertically with respect to the second motor shaft in response to the signal received by the third motor from outside.

7. The sheet material feeding apparatus according to claim 1, further comprising:

a first elastic member that has an end fixed to the housing as well as a central portion fixed to the roll support member.

8. The sheet material feeding apparatus according to claim 7, further comprising:

a second elastic member that has an end fixed to the housing as well as a central portion fixed to the roll support member, the second elastic member being arranged vertically below the first elastic member.

9. The sheet material feeding apparatus according to claim 1, wherein the eccentric cam is rotated in synchronization with a working process of a press apparatus that is processing the sheet material.

10. The sheet material feeding apparatus according to claim 9, wherein the eccentric cam is rotated in response to a control signal from the press apparatus.

11. The sheet material feeding apparatus according to claim 10, further comprising:

an eccentric cam bearing in which the eccentric cam is rotated and through which a force for moving the cam piston horizontally is transmitted.

12. The sheet material feeding apparatus according to claim 11, wherein the joining device is held between a shaft of the second roll and the second motor shaft and includes a first elongated projection that engages a first elongated slot formed on the shaft of the second roll and a second elongated projection that engages a second elongated slot formed on the second motor shaft.

13. The sheet material feeding apparatus according to claim 12, wherein the first elongated projection and the first elongated slot extends in a first direction and the second elongated projection and the second elongated slot extends in a second direction that is perpendicular to the first direction.

* * * * *